US008737880B2

(12) United States Patent
Uehara

(10) Patent No.: US 8,737,880 B2
(45) Date of Patent: May 27, 2014

(54) IMAGE FORMING DEVICE INCLUDING OUTER COVER AND JAM COVER LINKED TO THE OUTER COVER

(71) Applicant: Brother Kogyo Kabushiki Kaisha, Nagoya (JP)

(72) Inventor: Junji Uehara, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 17 days.

(21) Appl. No.: 13/653,871

(22) Filed: Oct. 17, 2012

(65) Prior Publication Data

US 2013/0038018 A1 Feb. 14, 2013

Related U.S. Application Data

(63) Continuation of application No. 12/559,963, filed on Sep. 15, 2009, now Pat. No. 8,315,539.

(30) Foreign Application Priority Data

Sep. 26, 2008 (JP) ..... 2008-248604

(51) Int. Cl.
*G03G 21/00* (2006.01)

(52) U.S. Cl.
USPC ..... 399/124; 271/279

(58) Field of Classification Search
USPC ..... 271/279; 399/124
See application file for complete search history.

(56) References Cited

U.S. PATENT DOCUMENTS

| | | | |
|---|---|---|---|
| 6,973,279 | B2 | 12/2005 | Yokoi |
| 7,386,255 | B2 | 6/2008 | Ochi |
| 7,747,196 | B2 | 6/2010 | Nobuoka et al. |
| 7,831,173 | B2 | 11/2010 | Kusukawa et al. |
| 7,890,018 | B2 | 2/2011 | Palumbo et al. |

FOREIGN PATENT DOCUMENTS

| | | |
|---|---|---|
| JP | 7-48046 | 2/1995 |
| JP | H07-199568 | 8/1995 |
| JP | H09-127753 | 5/1997 |
| JP | 2004-45940 | 2/2004 |
| JP | 2004-240354 | 8/2004 |

OTHER PUBLICATIONS

Microfilm of Japanese Utility Model Application No. JP S63-008333 (Japanese Utility Model Application Publication No. JP H01-113245) published Jul. 31, 1989 together with English bibliographic data.
Japanese Official Action dated Aug. 3, 2010 from related JP 2008-248604 filed on Sep. 26, 2008.
U.S. Official Action dated Mar. 9, 2012 from related U.S. Appl. No. 12/559,963, filed Sep. 15, 2009.
Notice of Allowance dated Jul. 18, 2012 from related U.S. Appl. No. 12/559,963, filed Sep. 15, 2009.

*Primary Examiner* — Kaitlin Joerger
(74) *Attorney, Agent, or Firm* — Scully, Scott, Murphy & Presser, PC

(57) ABSTRACT

An image forming device includes a casing formed with an opening, a pivot member pivotably disposed in the casing so as to be selectively opened and closed, a cover disposed outward of the pivot member, a lock mechanism that maintains a closed state of the pivot member, a link mechanism and a first roller and a second roller that together convey a recording medium, the first roller being supported by the pivot member, wherein the first roller moves away from the second roller when the pivot member is in the opened state.

16 Claims, 14 Drawing Sheets

IMAGE FORMING DEVICE INCLUDING OUTER COVER AND JAM COVER LINKED TO THE OUTER COVER

CROSS REFERENCE TO RELATED APPLICATION

This application is a continuation application of U.S. Ser. No. 12/559,963 filed on Sep. 15, 2009 and claims priority from Japanese Patent Application No. 2008-248604 filed Sep. 26, 2008. The entire content of each of which are incorporated herein by reference.

TECHNICAL FIELD

The present invention relates to an image forming device having a pivot cover.

BACKGROUND

There has been proposed a technology to prevent damage to a cover pivotably provided to a device by preventing the cover from opening beyond a predetermined angle. For example, when the cover opens beyond the predetermined angle, a torsion spring applies, on the cover, resilient force in a closing direction of the cover.

SUMMARY

It is an object of the invention to provide a technology that prevents damage to a pivot cover and that stabilizes an open state of the pivot cover. In order to attain the above and other objects, the invention provides an image forming device including a casing, an image forming unit, a pivot member, a cover, a lock mechanism, a link mechanism and a first roller and a second roller. The casing is formed with an opening. The image forming unit is disposed in the casing for forming an image on a recording medium. The pivot member is pivotably disposed in the casing so as to be selectively opened and closed. The cover disposed outward of the pivot member and is pivotable to selectively open and close the opening. The lock mechanism maintains a closed state of the pivot member. The link mechanism transmits a first force to the pivot member. The first roller and the second roller together convey the recording medium, the first roller being supported by the pivot member, wherein the first roller moves away from the second roller when the pivot member is in the opened state.

BRIEF DESCRIPTION OF THE DRAWINGS

The particular features and advantages of the invention as well as other objects will become apparent from the following description taken in connection with the accompanying drawings, in which:

FIG. 4(*b*) is an enlarged view of a portion encircled by a solid line A in FIG. 4(*a*);

FIG. 6(*b*) is a cross-sectional partial view of the image forming device with the first discharge roller and the pinch roller at an upper position;

FIG. 8(*b*) is an illustrative view showing an operation of the pressure-roller displacing mechanism;

FIG. 11(*b*) is an enlarged view of a portion encircled by a solid line A in FIG. 11(*a*);

FIG. 14(*b*) is an illustrative view of the comparison structure;

DETAILED DESCRIPTION

Figure 1:
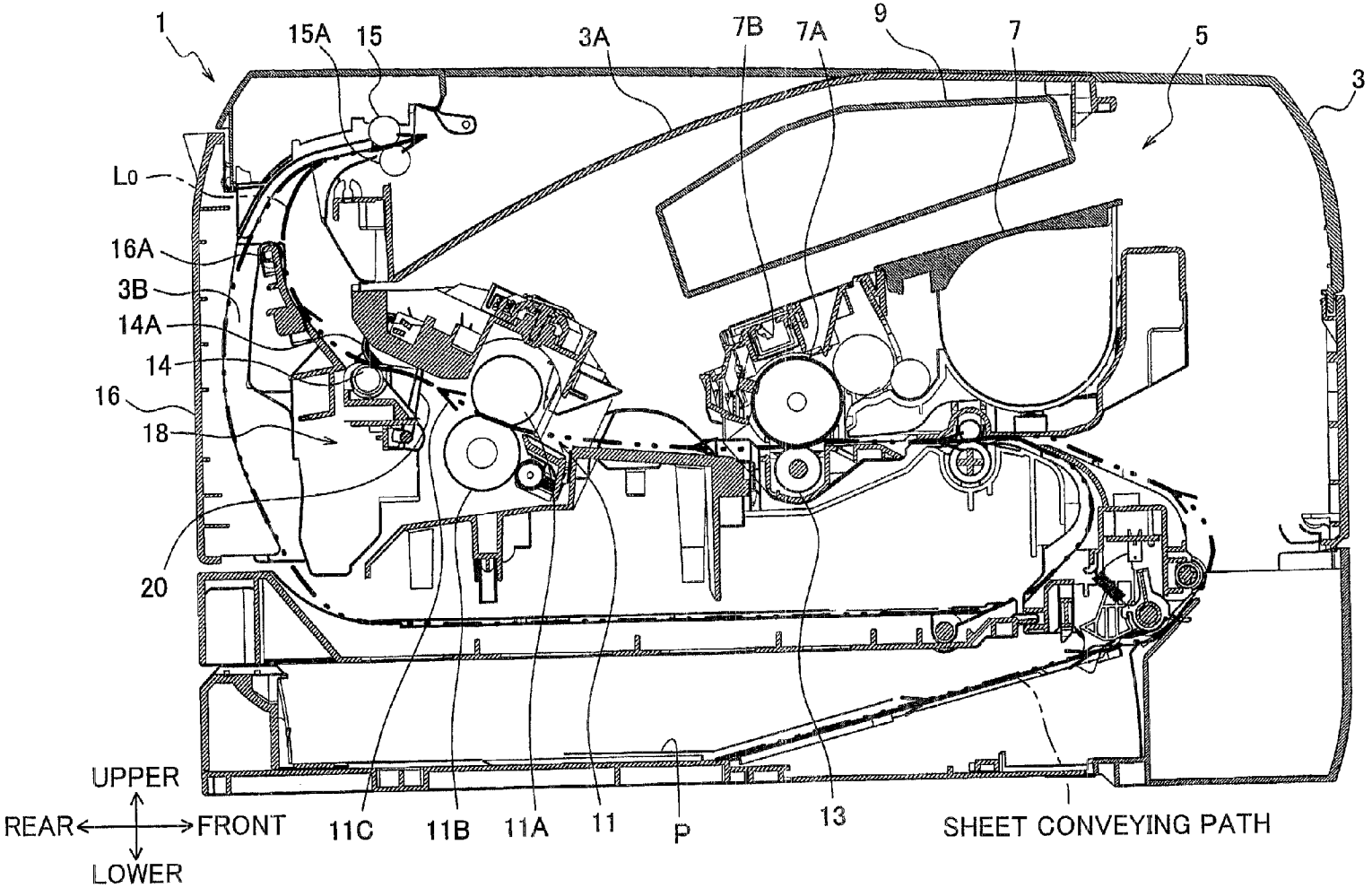
FIG. 1 is a cross-sectional view of an image forming device according to an embodiment of the invention.

An image forming device according to an embodiment of the invention will be described while referring to the accompanying drawings wherein like parts and components are designated by the same reference numerals to avoid duplicating description.

The terms "upward", "downward", "upper", "lower", "above", "below", "right", "left", "front", "rear" and the like will be used throughout the description assuming that the image forming device is disposed in an orientation in which it is intended to be used.

As shown in FIG. 1, an image forming device 1 of an embodiment of the invention includes a casing 3 and an image forming section 5 disposed within the casing 3. The image forming section 5 forms images on such recording medium P as paper sheet, OHP sheet, and the like (hereinafter referred to as "paper sheet") with an electrophotographic method by transferring developing-material images onto the paper sheet P. The image forming section 5 includes a process cartridge 7, an exposing unit 9, a transfer roller 13, a fixing unit 11, and the like.

The process cartridge 7 includes a photosensitive drum 7A, a charging unit 7B, and the like. The charging unit 7B is for charging an outer peripheral surface of the photosensitive drum 7A. The exposing unit 9 is for exposing the charged outer peripheral surface of the photosensitive drum 7A with scanning of a laser light so as to form electrostatic latent images thereon. Supplying electrically-charged developing material onto the exposed outer peripheral surface of the photosensitive drum 7A forms developing-material images corresponding to the electrostatic latent images thereon.

The transfer roller 13 is disposed in opposition to the photosensitive drum 7A for transferring developing-material images from the photosensitive drum 7A onto a print surface of the paper sheet P. The paper sheet P with the developing-material images transferred thereon is conveyed to the fixing unit 11.

The fixing unit 11 is for fixing the developing-material images onto the paper sheet P by applying heat. More specifically, the fixing unit 11 includes a heat roller 11A and a pressure roller 11B. The heat roller 11A is disposed on a print-surface side of the paper sheet P and conveys the paper sheet P while applying heat to the developing-material images formed thereon. The pressure roller 11B is disposed on the opposite side of a sheet conveying path from the heat roller 11A and presses the paper sheet P on the sheet conveying path against the heat roller 11A. The pressure roller 11B can be displaced relative to the heat roller 11A by a pressure-roller displacing mechanism 25 (FIG. 8(*a*)), which will be described later. The paper sheet P with the images fixed thereon is discharged out of the fixing unit 11 through a discharge opening 11C.

The image forming device 1 further includes a first discharge roller 14, a pinch roller 14A, a conveying chute 16A, a second discharge roller 15, a pinch roller 15A, and a discharge tray 3A. The first discharge roller 14 conveys upward the paper sheet P discharged from the fixing unit 11. The conveying chute 16A defines a substantial-U-shaped conveying path Lo that changes a conveying direction of the paper sheet P about 180 degrees. The substantial-U-shaped conveying path Lo extends from the image forming section 5 to the discharge tray 3A. The second discharge roller 15 discharges the paper sheet P onto the discharge tray 3A that is formed at the top of the casing 3.

Figure 12:
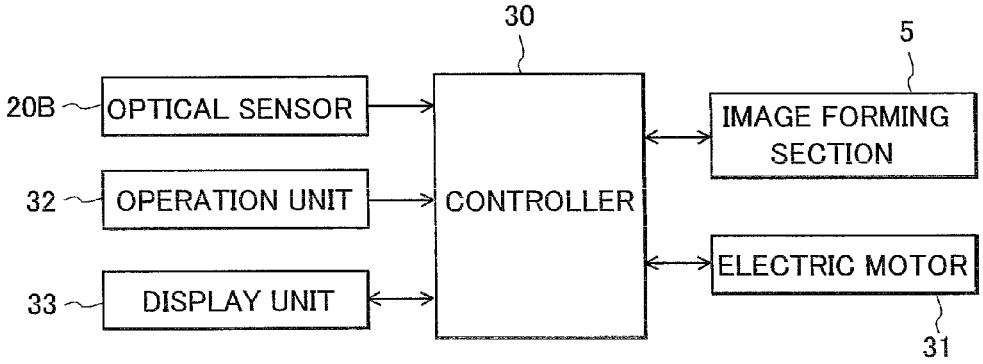
FIG. 12 is a block diagram of an electrical configuration of the image forming device.

The first and second discharge rollers 14 and 15 are drive rollers that are driven to rotate by driving force from an electric motor 31 (FIG. 12). The pinch roller 14A presses the paper sheet P against the first discharge roller 14 and rotates following rotation of the first discharge roller 14. The pinch roller 15A presses the paper sheet P against the second discharge roller 15 and rotates following rotation of the second discharge roller 15.

Figure 2:
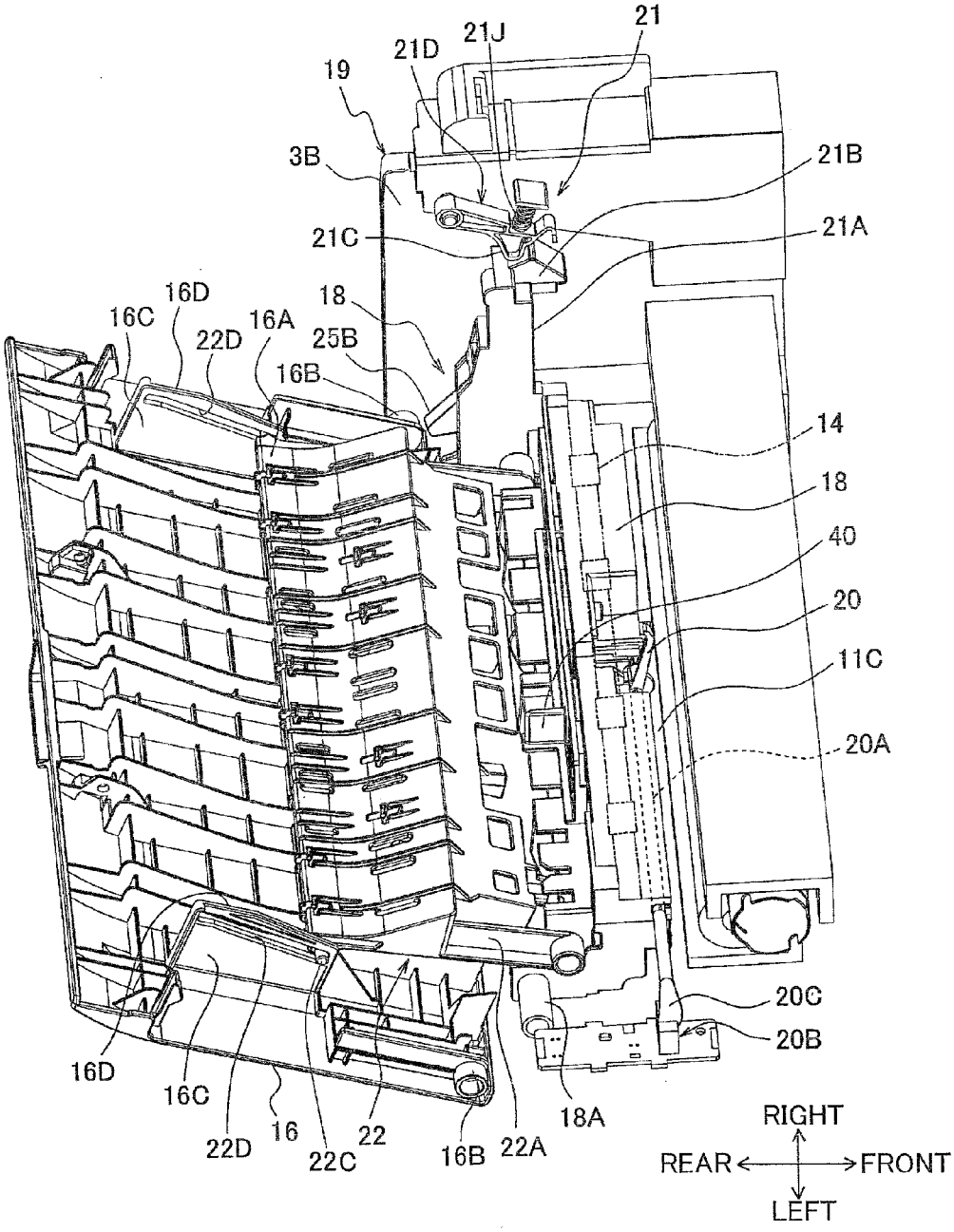
FIG. 2 is a perspective partial view of the image forming device with a rear cover opened to a first predetermined angle.

The casing 3 is formed with an opening 3B at the rear side. A rear cover 16 in a substantial-plate shape is provided to selectively open and close the opening 3B. As shown in FIG. 2, the rear cover 16 is pivotably attached to a pair of main frames 19 (only one main frame 19 is shown in FIG. 2) of the casing 3 via a pair of pivot shafts 16B. In this embodiment, when an image forming operation is performed with the rear cover 16 being open, the paper sheet P formed with images thereon is discharged through the opening 3B onto the rear cover 16.

The main frames 19 serve as at least a part of a main body to which the process cartridge 7 and the fixing unit 11 are attached. Each of the main frames 19 is in a plate-like shape and disposed on either side of the image forming device 1 in a lateral (right-to-left) direction.

Figure 3:
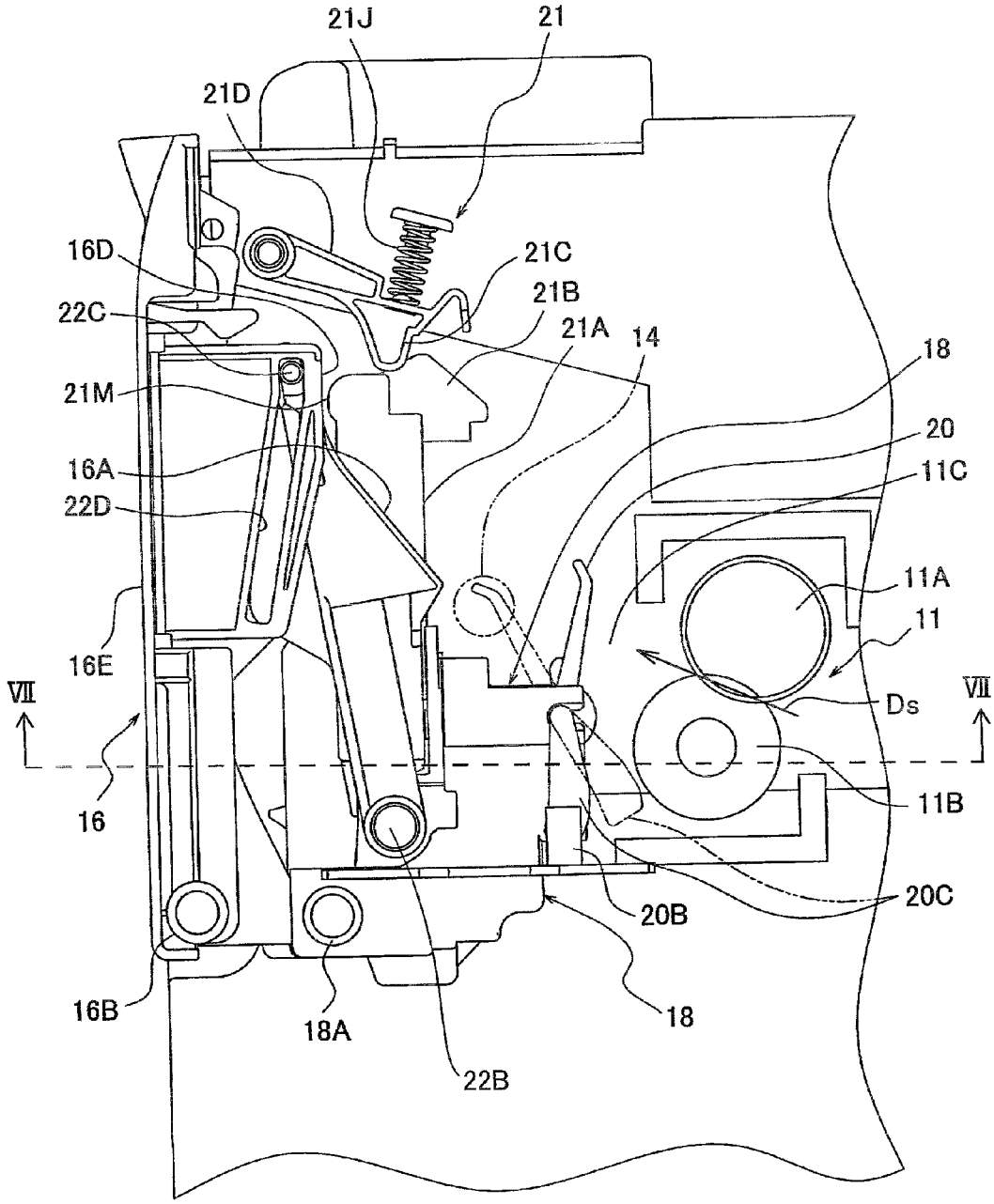
FIG. 3 is a cross-sectional partial view of the image forming device with the rear cover in a closed state.
Figure 4B:
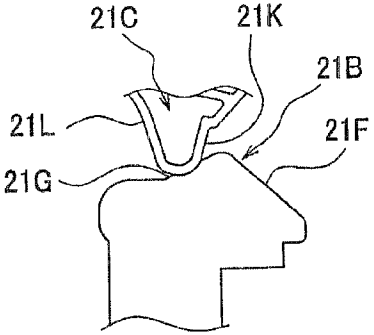
FIG. 4(*a*) is a cross-sectional partial view of the image forming device with the rear cover opened to the first predetermined angle and a jam cover in a closed state.
Figure 4A:
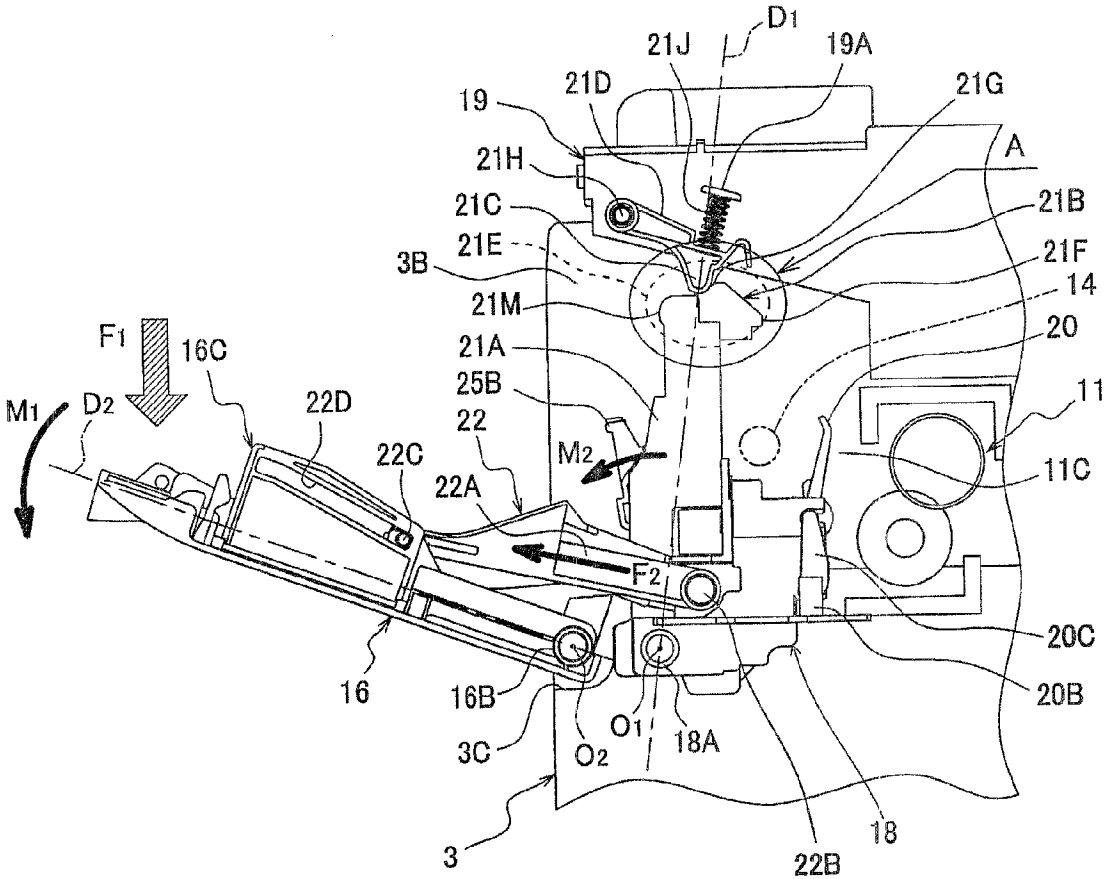
Figure 5:
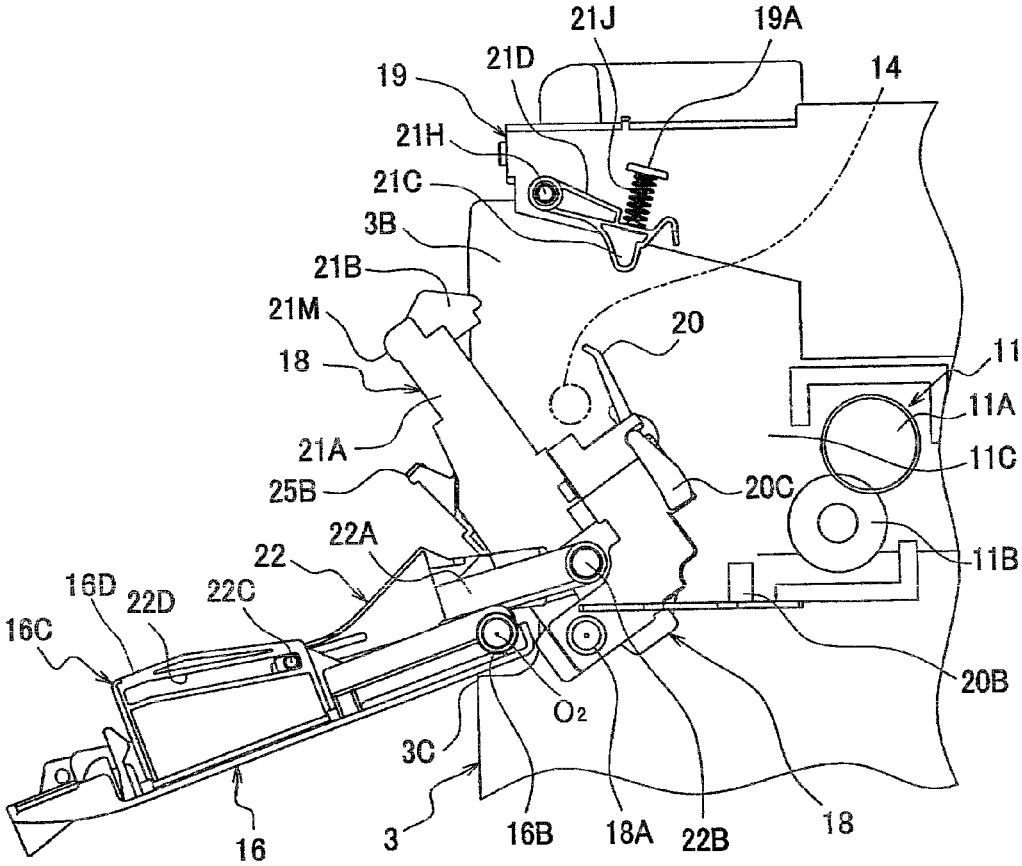
FIG. 5 is a cross-sectional partial view of the image forming device with the rear cover opened to a second predetermined angle and the jam cover in an open state.

As shown in FIGS. 3 and 5, a jam cover 18 is disposed within the casing 3 at a position between the rear cover 16 and the fixing unit 11 and pivotably attached to the main frames 19 via pivot shafts 18A (only one pivot shaft 18A is shown in FIGS. 3 and 5). When the jam cover 18 is closed as shown in FIGS. 3 and 4(*a*), the jam cover 18 covers the rear side of the fixing unit 11 and partially defines the substantial-U-shaped conveying path Lo.

The first discharge roller 14 is supported to the jam cover 18, so that the first discharge roller 14 is displaced together with the jam cover 18 about the pivot shafts 18A. When the jam cover 18 opens by tilting rearward about the pivot shafts 18A from a position shown in FIG. 4(*a*) to a position shown in FIG. 5, the first discharge roller 14 is detached from the pinch roller 14A, and the substantial-U-shaped sheet conveying path Lo (FIG. 1) formed on the rear side of the fixing unit 11 is exposed.

As shown in FIGS. 2 and 4(*a*), a sensor actuator 20 is pivotably disposed at a front side of the jam cover 18 for detecting whether or not a leading or trailing edge of the paper sheet P has passed a detecting position where the sensor actuator 20 is located.

Note that the first discharge roller 14 is indicated by dotted chain lines in FIGS. 2 to 5 so as to illustrate the sensor actuator 20.

The sensor actuator 20 is disposed in a substantial center of the discharge opening 11C in the lateral direction. The sensor actuator 20 is fixed to a pivot shaft 20A so that the sensor actuator 20 and the pivot shaft 20A move as a unit. The pivot shaft 20A is elongated to a position of a transmission-type optical sensor 20B disposed on the left side of the jam cover 18.

Although not shown in the drawings, the optical sensor 20B includes a light emitting element and a light receiving element which are disposed opposing each other with a predetermined interval therebetween. The optical sensor 20B is in an ON state when a light emitted from the light emitting element is received at the light receiving element, and is in an OFF state when the light is not received.

A light shield 20C is disposed on a left end of the pivot shaft 20A nearest the optical sensor 20B such that the pivot shaft 20A and the light shield 20C move as a unit. The light shield 20C moves between a position on an optical path of the light emitted from the light emitting element of the optical sensor 20B and a position off the optical path.

Therefore, when no paper sheet P is in the detecting position, the sensor actuator 20 and the light shield 20C are at positions indicated by solid lines in FIG. 3, so the optical sensor 20B is in the OFF state. On the other hand, the sensor actuator 20 and the light shield 20C are at positions indicated by dotted chain lines in FIG. 3 during the time between when the leading edge of the paper sheet P in a sheet conveying direction Ds abuts the sensor actuator 20 and when the trailing edge of the paper sheet P is past the detecting position, so the optical sensor 20B is in the ON state.

As shown in FIG. 2, a lock mechanism 21 is disposed at a right side of the jam cover 18 for maintaining the jam cover 18 closed. The lock mechanism 21 includes a cover-side arm 21A, an engaging member 21B, an engaged member 21C, an engaging lever 21D, and a spring 21J.

As shown in FIG. 4(*a*), the cover-side arm 21A is integrally formed with the jam cover 18 and extends upward from a pivot-shaft-18A side. More specifically, the cover-side arm 21A extends in a direction substantial parallel to a radiation direction D1 of a pivot center O1 of the jam cover 18. The cover-side arm 21A has a pressed member 21M having a rounded surface.

The engaging member 21B is integrally formed with the cover-side arm 21A at a top end 21E thereof. As shown in FIG. 4(*b*), the engaging member 21B is in a substantial triangle shape with an angle pointing upward when viewed in the axial direction of the pivot shaft 18A also.

The engaging member 21B has a first sloping surface 21F at the front side and a second sloping surface 21G at the rear side. Both the first sloping surface 21F and the second sloping surface 21G are tilting with respect to a direction in which the cover-side arm 21A extends, i.e., the radiation direction D1 (FIG. 4(*a*)). The second sloping surface 21G is formed continuous with the first sloping surface 21F with their junction forming a smooth surface protruding upward.

As shown in FIG. 4(*a*), the engaging lever 21D is pivotably attached to an inner side surface of the main frame 19 at its base end via a pivot shaft 21H. The engaged member 21C is provided to a free end of the engaging lever 21D and engaged with the engaging member 21B.

As shown in FIG. 4(*b*), the engaged member 21C is in a substantial inverted triangle shape with an angle pointing downward when viewed in the axial direction of the pivot shaft 18A. The engaged member 21C has a first sloping surface 21K at the front side and a second sloping surface 21L at the rear side. The second sloping surface 21L is formed continuous with the first sloping surface 21K with their junction forming a smooth surface protruding downward.

As shown in FIG. 4(*a*), one end of the spring 21J in the axial direction is attached to the engaging lever 21D, and the other end is in contact with a seat 19A provided to the main frame 19. With this configuration, the spring 21J elastically urges the engaging lever 21D toward the engaging member 21B, thereby urging the engaged member 21C toward the engaging member 21B.

As shown in FIGS. 2 and 4(*a*), the rear cover 16 is linked to the jam cover 18 via a linking mechanism 22. The linking mechanism 22 includes a linking member 22A that is formed of resin in a substantial plate shape. The linking member 22A functions as the conveying chute 16A.

The linking member 22A is pivotably coupled to lateral ends of the jam cover 18 via pivot shafts 22B at one end and also to the rear cover 16 via pivot shafts 22C at the other end. Also, the link member 22A is movable relative to the rear cover 16 in a direction substantial parallel to a direction D2 from a pivot center O2 of the rear cover 16 toward a free end of the rear cover 16.

More specifically, the rear cover 16 includes a pair of guide walls 16C disposed one at either lateral side thereof. The guide walls 16C regulate positions of lateral edges of the paper sheet P when the paper sheet P is discharged onto the rear cover 16 through the opening 3B. Each guide wall 16C is formed with a groove 22D that is elongated in a direction substantial parallel to the direction D2. Each of the pivot shafts 22C of the linking member 22A is slidably and rotatably fitted in the groove 22D. With this configuration, the pivot shaft 22C rotates and moves in a direction substantial parallel to the direction D2 along the corresponding groove 22D, following opening/closing movement (pivoting movement) of the rear cover 16.

That is, when the rear cover 16 is in an open state as shown in FIG. 4(*a*), the pivot shaft 22C is located at an end in a longitudinal direction of the groove 22D nearest the shaft 16B. On the other hand, when the rear cover 16 is in a closed state as shown in FIG. 3, the pivot shaft 22C is located at the other end of the groove 22D farthest from the shaft 16B.

Note that in this embodiment, the longitudinal direction of the groove 22D is not perfect parallel to the direction D2, but is slightly angled therefrom, because the linking member 22A pivots about the pivot shafts 22B.

Therefore, when it is stated that the pivot shaft 22C moves in a direction substantial parallel to the direction D2, it means in a broad sense that the pivot shaft 22C moves between the side nearest the pivot center O2 and the side nearest the free end of the rear cover 16, but does not mean in a narrow sense that the pivot shaft 22C moves in a direction substantial parallel to the direction D2.

As shown in FIG. 2, each of the guide walls 16C is formed at one end with a pressing member 16D, and the pressing member 16D of the guide wall 16C on the right side presses the jam cover 18 in a closing direction of the jam cover 18 when the rear cover 16 moves in a closing direction of the rear cover.

As shown in FIG. 5, a stopper 3C is formed at a bottom edge of the opening 3B, i.e., an edge of the opening 3B nearest the pivot center O2 of the rear cover 16. The stopper 3C prevents the rear cover 16 from opening beyond the position shown in FIG. 5.

As shown in FIG. 2, the image forming device 1 further includes an operating member 40 that is a component of a rollers-displacing mechanism for displacing the first discharge roller 14 and the pinch roller 14A in a direction (vertical direction) orthogonal to their axis direction.

Figure 6A:
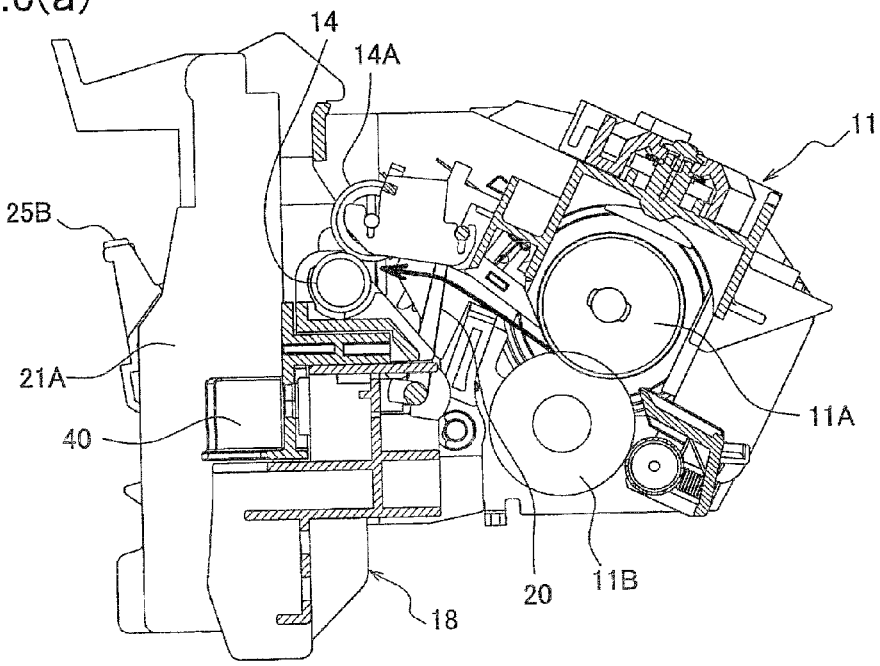
FIG. 6(*a*) is a cross-sectional partial view of the image forming device with a first discharge roller and a pinch roller at a lower position.
Figure 6B:
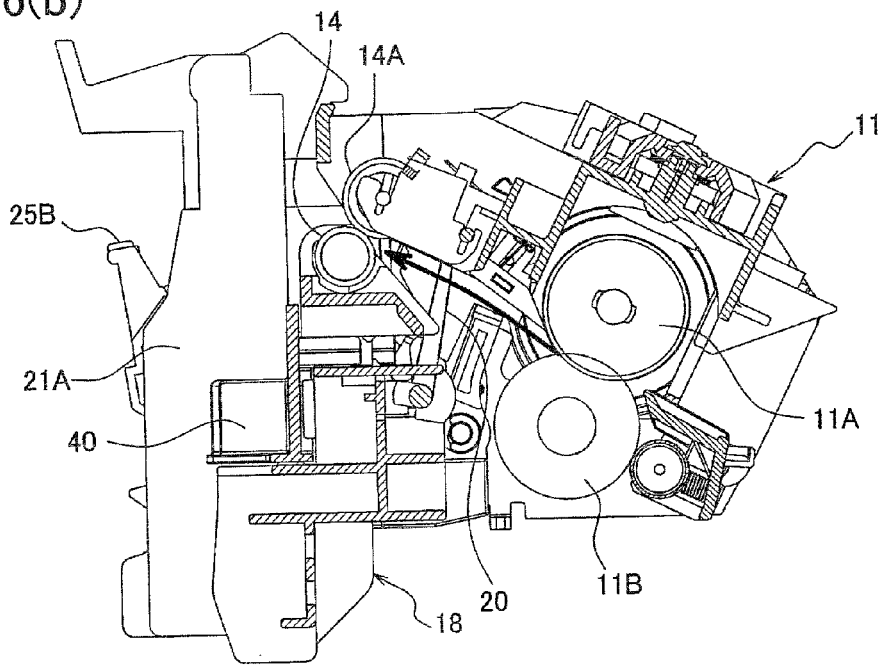
Figure 7:
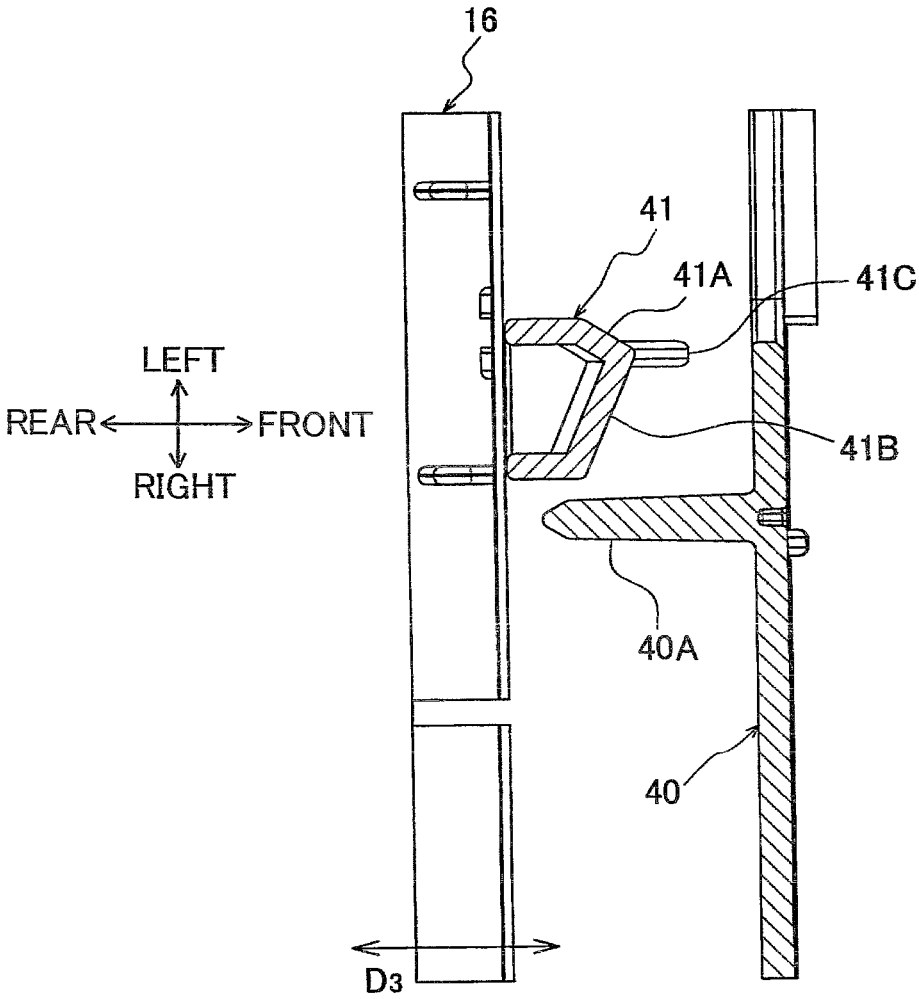
FIG. 7 is a cross-sectional view taken along a line VII-VII of FIG. 3.

The operating member 40 is movably attached to the jam cover 18. As shown in FIG. 7, the operating member 40 has a protruding part 40A that protrudes toward the rear cover 16. The operating member 40 is movable in the lateral direction of the image forming device 1 between a first position and a second position on the right side of the first position. When the user moves the operating member 40 to the first position, the first discharge roller 14 and the pinch roller 14A (hereinafter collectively referred to as "the rollers 14 and 14A") are displaced downward to a lower position shown in FIG. 6(*a*). On the other hand, when the operating member 40 is moved to the second position, the rollers 14 and 14A are displaced upward to an upper position shown in FIG. 6(*b*).

As shown in FIG. 7, a position setter 41 is provided to the rear cover 16 at a position opposing the operating member 40 when the rear cover 16 is closed. The position setter 41 is for moving the operating member 40 to either the first position or the second position in the course of closing the rear cover 16.

The position setter 41 has a first sloping surface 41A, a second sloping surface 41B, and a separator wall 41C at a junction of the first sloping surface 41A and the second sloping surface 41B.

The first sloping surface 41A extends in a direction intersecting a moving direction (opening direction) D3 of the rear cover 16 so that the first sloping surface 41A becomes closer to the rear cover 16 toward the left, and the second sloping surface 41B extends in a direction intersecting the moving direction D3 so that the second sloping surface 41B becomes closer to the rear cover 16 toward the right.

Therefore, when a rear end of the protruding part 40A contacts the first sloping surface 41A in the course of closing the rear cover 16, the operating member 40 is moved leftward to the first position while slidingly contacting the first sloping surface 41A as the rear cover 16 comes closer to the jam cover 18. On the other hand, when the rear end of the protruding part 40A contacts the second sloping surface 41B in the course of closing the rear cover 16, the operating member 40 is moved rightward to the second position while slidingly contacting the second sloping surface 41B as the rear cover 16 comes closer to the jam cover 18.

Therefore, when the rear cover 16 is in the closed state, the operating member 40 is always located at either the first position or the second position. The separator wall 41C is for reliably guiding the protruding part 40A to the first sloping surface 41A or the second sloping surface 41B.

Because the configuration and purpose of the rollers-displacing mechanism are well-known in the art, further description thereof will be omitted.

When the rear cover 16 is opened to a first predetermined angle as shown in FIG. 4(*a*), the pivot shaft 22C is at the end of the groove 22D nearest the pivot shaft 16B, and is prevented from moving further toward the pivot center O2 of the rear cover 16. Therefore, the rear cover 16 rests in a state shown in FIG. 4(*a*). The state of the rear cover 16 shown in FIG. 4(*a*) will be referred to as "first-angle open state" in the following description.

As mentioned above, when an image forming operation is performed with the rear cover 16 in the first-angle open state shown in FIG. 4(*a*), a paper sheet P formed with images thereon is discharged through the opening 3B onto the rear cover 16. That is, the rear cover 16 also functions as a discharge tray. Because the rear cover 16 is set stable in the first-angle open state and prevented from shaking, it is possible to prevent the paper sheets P from being scattered on the rear cover 16.

When a force F1 in a direction to open the rear cover 16 wider is exerted on the rear cover 16 in the first-angle open state, a force F2 is exerted on the linking member 22A by a moment M1 of the force F1 trying to make the rear cover 16 pivot further in the opening direction. As a result, a moment M2 for opening the jam cover 18 is applied on the jam cover 18 through the link mechanism 22. In the following description, the moment M2 will be referred to as an "opening force".

On the other hand, the lock mechanism 21 generates a retaining force against the opening force M2 with the spring 21J pressing the engaged member 21C against the engaging member 21B so as to maintain the closed state of the jam cover 18. That is, the retaining force is resulting from a resilient force of the spring 21J that engages the engaging member 21B with the engaged member 21C, and the retaining force is an engaging force between the engaging member 21B and the engaged member 21C resulting from the resilient force of the spring 21J.

Therefore, when the retaining force is greater than the opening force M2, the rear cover 16 rests in the first-angle open state as shown in FIG. 4(*a*). On the other hand, when the opening force M2 is greater than the retaining force, the rear cover 16 pivots together with the jam cover 18 in the opening direction beyond the first predetermined angle against the retaining force as shown in FIG. 5.

In other words, the rear cover 16 freely opens to the first predetermined angle. However, when the rear cover 16 opens beyond the first predetermined angle, the opening force M2 in the opening direction of the jam cover 18 is applied on the jam cover 18.

When the rear cover 16 and the jam cover 18 open against the retaining force, the opening fore applied on the rear cover 16 is absorbed by the lock mechanism 21 when the lock mechanism 21 is released (i.e., when the engaging member 21B disengages from the engaged member 21C). This prevents large impact force from being applied on the rear cover 16, thereby damages to the jam cover 18 and the rear cover 16 can be prevented.

Because the retaining force of the lock mechanism 21 is resulting from the resilient force of the spring 21J as described above, amount of variation in the retaining force changes in proportion to amount of variation in the resilient force of the spring 21J. Also, because the engaging member 21B and the engaged member 21C of the lock mechanism 21 are located at positions remote from the pivot center O1 of the jam cover 18, a relatively large retaining force can be ensured even if the resilient force is set small.

Therefore, it is possible to use the spring 21J with small resilient force. Utilizing the spring 21J with small resilient force is an easy way to reduce the amount of variation in the resilient force and thus the retaining force of the lock mechanism 21.

Because the amount of variation in retaining force of the lock mechanism 21 is minimized in this manner, it is possible to prevent fluctuation in timing at which the lock mechanism 21 is released by the opening force M2, thereby reliably preventing damages to the rear cover 16 and the jam cover 18.

Because the rear cover 16 is not held open by a balanced force between an opening force and a resilient force, the rear cover 16 can stay open without shaking Thus, the open state of the rear cover 16 can be stabilized, and damages to the rear cover 16 and the jam cover 18 can be prevented.

When the rear cover 16 opens beyond the first predetermined angle to the second predetermined angle shown in FIG. 5, a base end portion of the rear cover 16 abuts the stopper 3C, thereby being prevented from further opening beyond the second predetermined angle.

Because the stopper 3C reliably prevents the rear cover 16 from opening beyond the second predetermined angle, damages to the rear cover 16 can be reliably prevented.

When the rear cover 16 is closed from the state shown in FIG. 5 where both the rear cover 16 and the jam cover 18 are open, the pressing member 16D of the rear cover 16 comes into contact with the pressed member 21M of the cover-side arm 21A, thereby pressing the cover-side arm 21A in the closing direction. As a result, when the rear cover 16 is closed, the jam cover 18 also is closed. This enhances convenience.

Note that, in the course of closing the jam cover 18, the pressing member 16D is in contact with the pressed member 21M and presses the cover-side arm 21A during when the second sloping surface 21L (FIG. 4(*b*)) of the engaged member 21C is in contact with the first sloping surface 21F of the engaging member 21B. However, when a peak of the engaged member 21C is past a peak of the engaging member 21B thereafter, the first sloping surface 21K of the engaged member 21C comes into contact with the second sloping surface 21G, and the rear cover 16 (pressing member 16D) separates from the pressed member 21M.

Thereafter, the resilient force of the spring 21J makes the peak of the engaged member 21C slide on the second sloping surface 21G of the engaging member 21B and brings the engaged member 21C into a complete engagement with the engaging member 21B as shown in FIG. 3.

It should be noted that the closed state of the jam cover 18 means a state in which a retaining force is applied on the jam cover 18 or the jam cover 18 has slightly pivoted open after the retaining force is released. The open state of the jam cover 18 means a state in which the jam cover 18 has fully pivoted open after the retaining force is released.

Because the groove 22D extends in the direction substantial parallel to the direction D2 (FIG. 4(*a*)) as described above, the longitudinal direction of the linking member 22A becomes substantial parallel to a rear surface 16E (FIG. 3) of the rear cover 16 when the rear cover 16 is closed as shown in FIG. 3. It should be noted that the longitudinal direction of the linking member 22A means a direction from the pivot shaft 22C via which the linking member 22A is coupled to the rear cover 16 toward the pivot shaft 22B via which the linking member 22A is coupled to the jam cover 18.

In other words, the longitudinal direction of the linking member 22A accommodated in the casing 3 is substantial parallel to the rear surface 16E of the rear cover 16. This prevents the image forming device 1 from being large-sized in the front-to-rear direction.

Figure 8A:
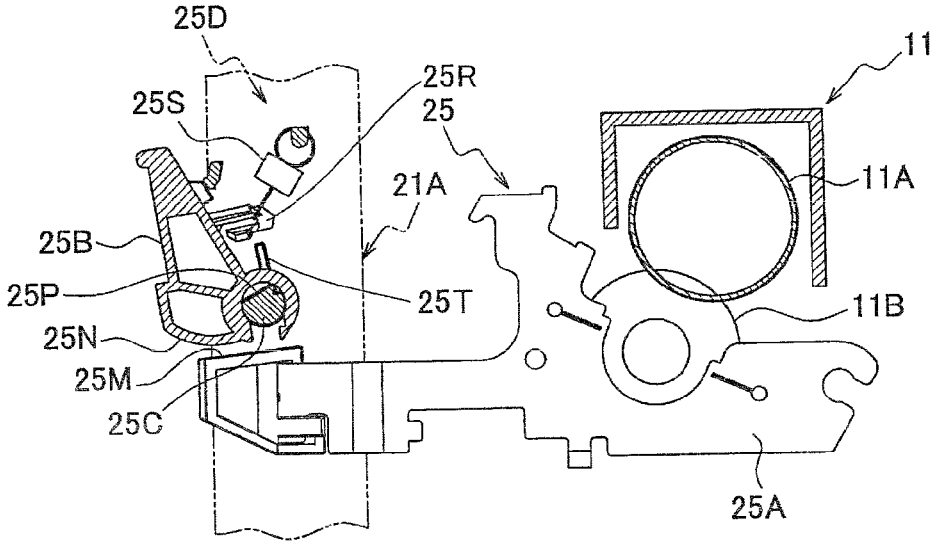
FIG. 8(*a*) is an illustrative view showing an operation of a pressure-roller displacing mechanism of the image forming device.
Figure 8B:
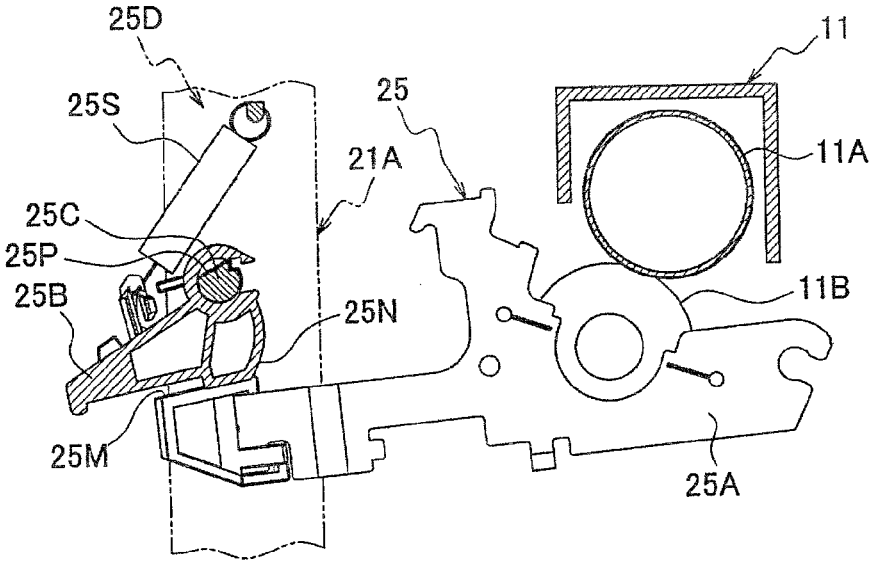

The image forming device 1 further includes the pressure-roller displacing mechanism 25 shown in FIGS. 8(*a*) and 8(*b*). The pressure-roller displacing mechanism 25 is for changing a pressing force against the heat roller 11A by changing the position of the pressure roller 11B relative to the heat roller 11A. The pressure-roller displacing mechanism 25 includes a pivot arm 25A and an operation lever 25B. The pivot arm 25A is for displacing the heat roller 11A, and the operation lever 25B is a member to be operated by the user.

More specifically, the pivot arm 25A is pivotably attached to a housing or the like of the fixing unit 11 at a rear end and extends toward the front. The pressure roller 11B is supported in a middle area of the pivot arm 25A in a longitudinal direction thereof (a position closer to the rear end than a center of the pivot arm 25A in this embodiment).

Although not shown in the drawings, there is also provided such resilient member as a spring (not shown) that urges the pivot arm 25A in a direction that the pressure roller 11B comes closer to the heat roller 11A. Thus, the resilient member generates resilient force that presses the paper sheet P sandwiched between the pressure roller 11B and the hear roller 11A against the heat roller 11A.

Figure 9:
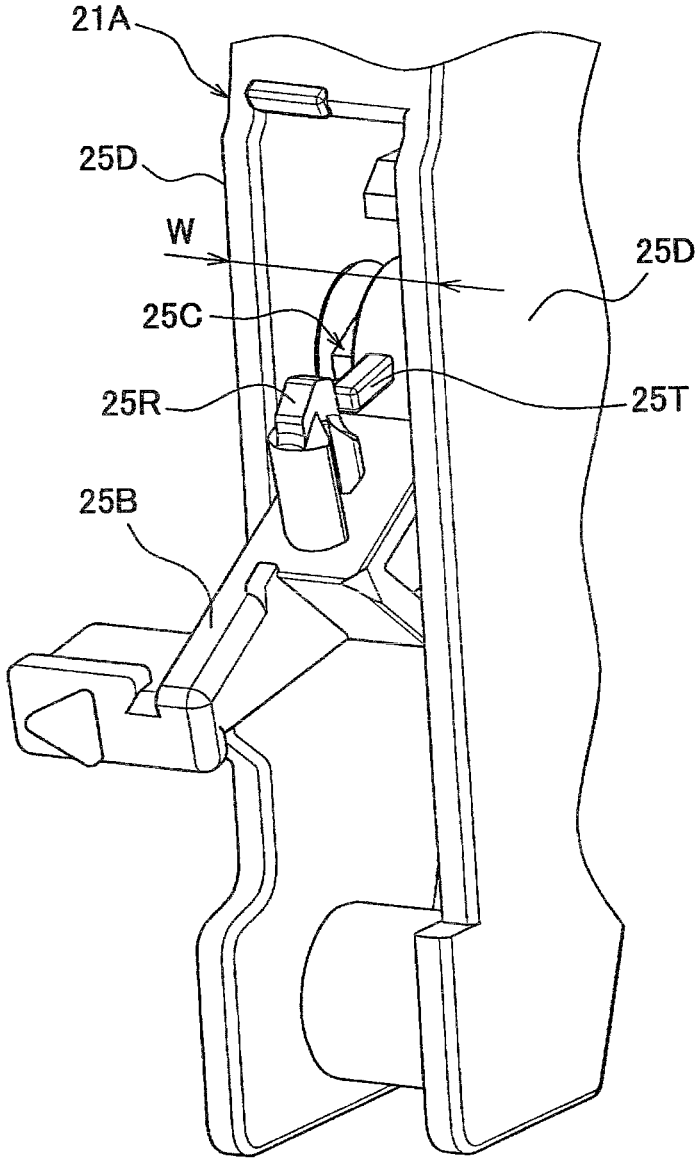
FIG. 9 is an enlarged perspective view of the pressure-roller displacing mechanism.
Figure 10:
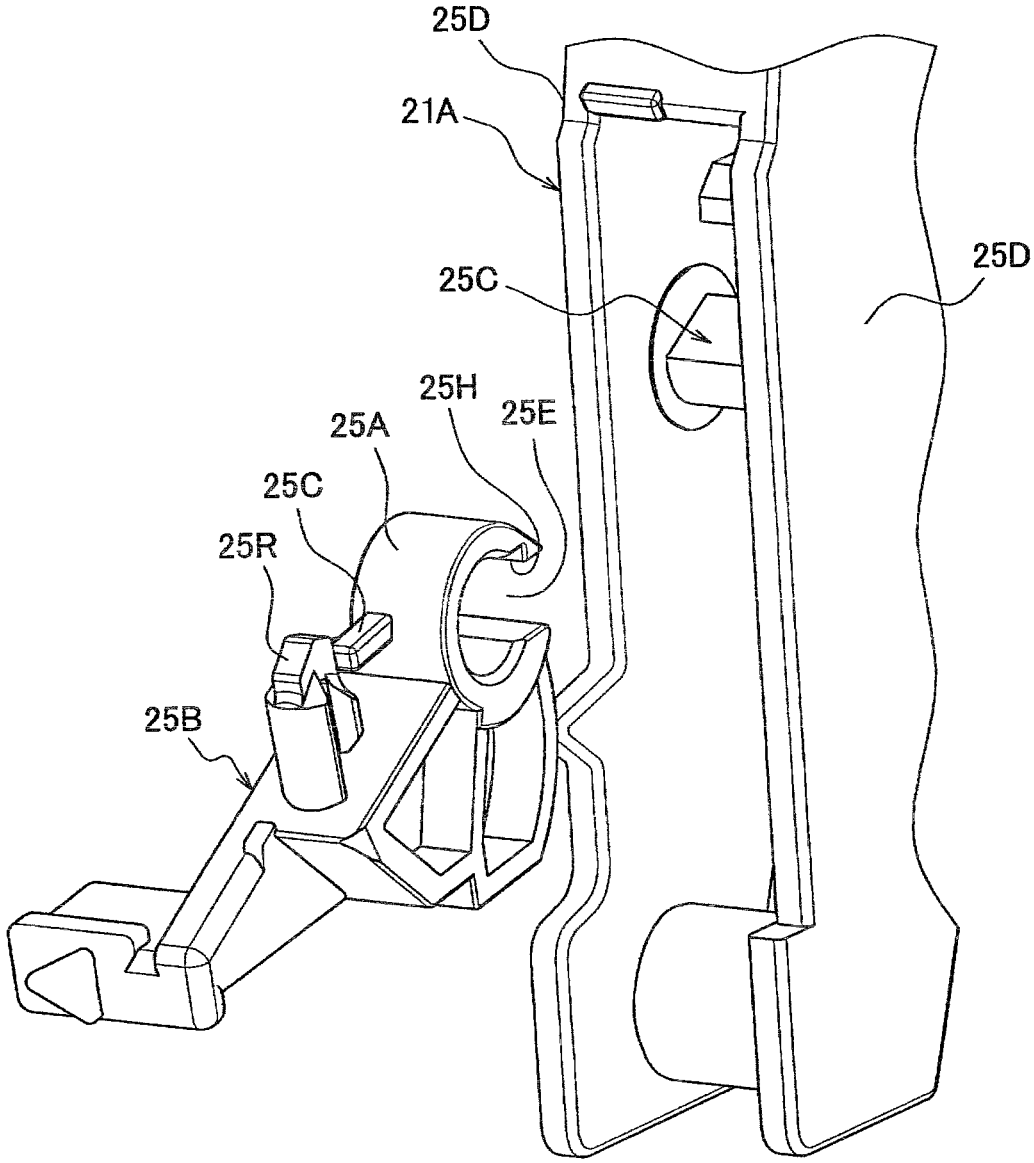
FIG. 10 is an exploded view of the pressure-roller displacing mechanism.

As shown in FIGS. 9 and 10, the cover-side arm 21A further includes a pair of plate-shaped support members 25D and a pivot shaft 25C extending between the support members 25D. The pivot shaft 25C, the support members 25D, and the engaging member 21B (FIG. 3) are formed of resin integrally with one another. The operation lever 25B is rotatably supported on the pivot shaft 25C.

Figure 11A:
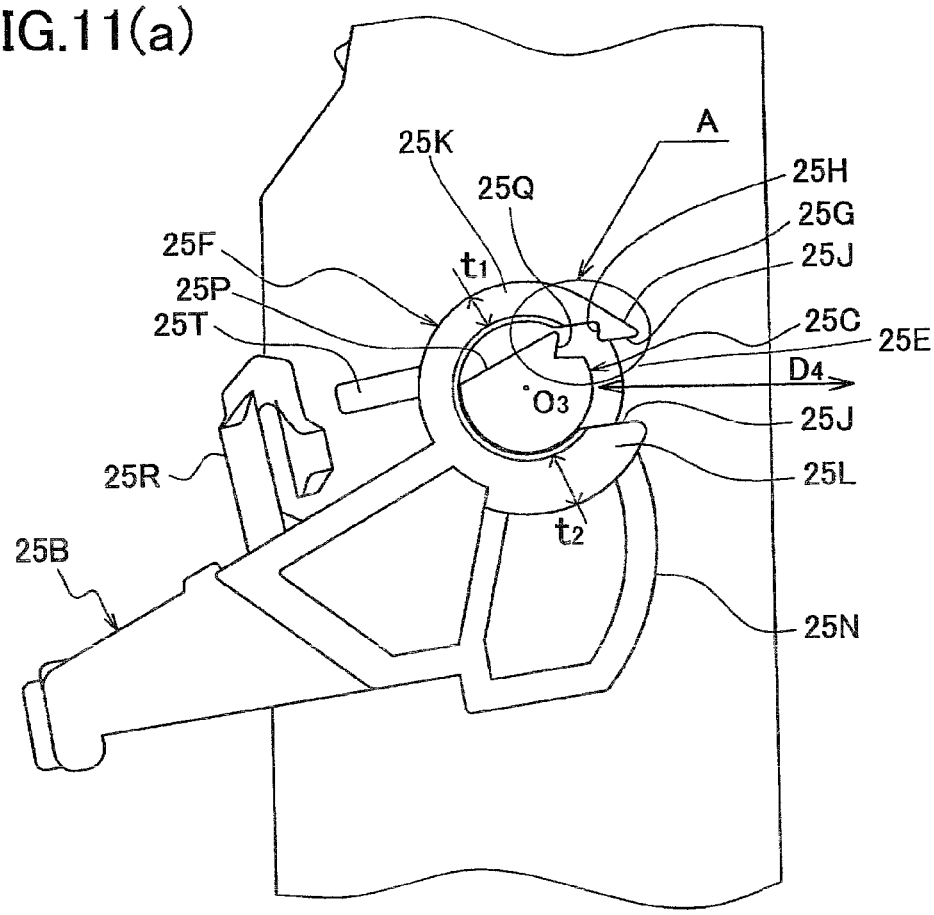
FIG. 11(*a*) is a cross-sectional view of the pressure-roller displacing mechanism.
Figure 11B:
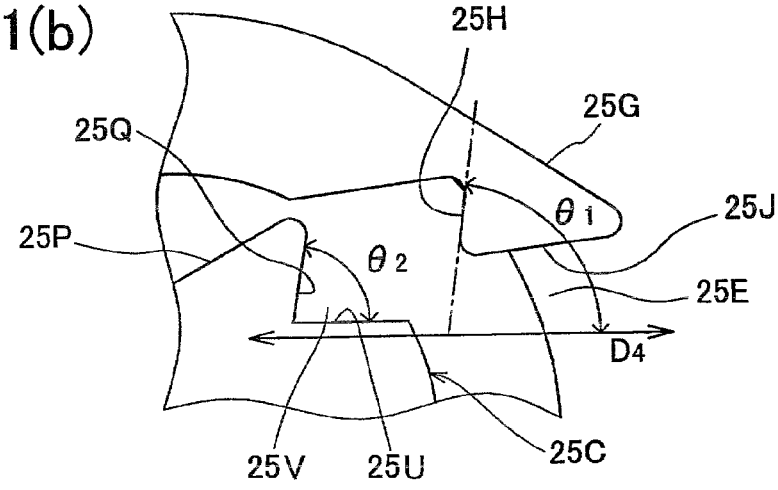

As shown in FIG. 11(*a*), the operation lever 25B is integrally formed with a substantial-C-shaped ring portion 25F formed with a cut-out part 25E defined by a pair of wall surfaces 25J. The operation lever 25B and the ring portion 25F are formed of resin. The ring portion 25F is rotatably fitted with the pivot shaft 25C, so that the operation lever 25B is rotatable relative to the pivot shaft 25C.

An inner peripheral surface of the ring portion 25F has a lever-side barb surface 25H at an edge 25G of the cut-out part 25E. The lever-side barb surface 25H extends in a direction intersecting an opening direction D4 of the cut-out part 25E when viewed in an axial direction of the pivot shaft 25C.

The opening direction D4 is parallel to a radiation direction from the center of the ring portion 25F. As shown in FIG. 11(*b*), the opening direction D4 is substantial parallel to the wall surface 25J.

In this embodiment, as shown in FIG. 11(*b*), an angle θ1 between the opening direction D4 and the lever-side barb surface 25H is set to 90 degrees or less so that the edge 25G of the cut-out part 25E forms a claw shape that protrudes toward the pivot shaft 25C.

As shown in FIG. 11(*a*), the ring portion 25F has a first arc portion 25K above the cut-out part 25E and a second arc portion 25L below the cut-out part 25E. The first arc portion 25K has a thickness t1 that is smaller than a thickness t2 of the second arc portion 25L, and the second arc portion 25L is formed on an outer peripheral surface with a cam section 25N. Thus, the second arc portion 25L has the bending rigidity that is substantially greater than the bending rigidity of the first arc portion 25K. The lever-side barb surface 25H is formed on the first arc portion 25K having the smaller bending rigidity. The cam section 25N is for pressing the pivot arm 25A while slidingly contacting a cam surface 25M (FIG. 8(*a*)) of the pivot arm 25A.

As shown in FIG. 11(*a*), the pivot shaft 25C has a substantial-D-shaped cross-section having a flat part 25P. As shown in FIGS. 8(*b*) and 11(*a*), the flat part 25P is on the opposite side of an axial center O3 of the pivot shaft 25C from the cam surface 25M (i.e., above the axial center O3, in this embodiment), and remaining of the cross-section that is on the same side of the axial center O3 as the cam surface 25M is in an arc shape.

As shown in FIG. 11(*b*), the outer periphery of the pivot shaft 25C caves in toward the shaft center O3 to form a caved part 25V defined by a shaft-side barb surface 25Q and a surface 25U near the flat part 25P. The shaft-side barb surface 25Q extends substantial parallel to the lever-side barb surface 25H when the operation lever 25B is in the state shown in FIG. 8(*a*) or 11(*b*). As shown in FIG. 11(*b*), an angle θ2 between the shaft-side barb surface 25Q and the surface 25U is set to 90 degrees or less.

As shown in FIG. 8(*a*), the operation lever 25B is also formed with a hook 25R and a latch 25T. The hook 25R is for supporting one end of a spring 25S. The other end of the spring 25S is fixed to one of the support members 25D. The spring 25S generates resilient force for holding the operation lever 25B at a first position shown in FIG. 8(*a*). The latch 25T is for preventing the spring 25S from disengaging from the hook 25R.

When the operation lever 25B is at a first position as shown in FIG. 8(*a*), the operation lever 25B is out of contact with the cam surface 25M of the pivot arm 25A, and the pivot arm 25A presses the pressure roller 11B toward the heat roller 11A.

It should be noted that although the heat roller 11A and the pressure roller 11B are depicted to overlap with each other in FIG. 8(*a*), the pressure roller 11B actually contacts the heat roller 11A while being partially deformed, because an outer periphery of the pressure roller 11B is formed of deformable material, such as rubber.

When the user operates and moves the operation lever 25B to a second position shown in FIG. 8(*b*), the pivot arm 25A is pushed in a direction away from the heat roller 11A, so that pressing force of the pressure roller 11B for pressing a paper sheet P against the heat roller 11A decreases. Thus, positioning the operation lever 25B at the second position is suited to a situation where printing is performed on a thick paper, such as an envelope.

Because the second arc portion 25L having high bending rigidity is formed with the cam section 25N that presses the pivot arm 25A, it is unnecessary to provide a separate member having high rigidity for forming the cam section 25N, preventing the shape of the operation lever 25B from being excessively complex.

When the operation lever 25B is rotated to a region outside a normal operation region of the operation lever 25B, the flat part 25P becomes substantial parallel to the opening direction D4 (FIG. 11(*b*)), thereby reliably preventing the operation lever 25B from coming off from the pivot shaft 25C.

The normal operation region of the operation lever 25B means a region between the first position shown in FIG. 8(*a*) and the second position shown in FIG. 8(*b*) of the operation lever 25B, and the operation lever 25B will be in the region outside the normal operation region if the operation lever 25B in the second position shown in FIG. 8(*b*) is further pivoted in the counterclockwise direction.

More specifically, as described above, the inner periphery of the ring portion 25F has the lever-side barb surface 25H at the edge 25G of the cut-out part 25E, and the pivot shaft 25C has the shaft-side barb surface 25Q. Therefore, when an external force F (FIG. 15) in the opening direction D4 is exerted on the operation lever 25B when the operation lever 25B is outside the normal operation region, the shaft-side barb surface 25Q comes into engagement with the lever-side barb surface 25H as shown in FIG. 15, and the shaft-side barb surface 25Q receives the external force F.

It should be noted that the external force F in the opening direction D4 means a force in a direction to pull out the operation lever 25B from the pivot shaft 25C among forces exerted on the operation lever 25B.

Because the direction of the shaft-side barb surface 25Q is substantially perpendicular to the direction of the external force F (i.e., the opening direction D4) when the operation lever 25B is outside the normal operation region, the external force F hardly causes a force in a direction to widen the ring portion 25F (i.e., a direction perpendicular to the direction of the external force F). Therefore, the operation lever 25B hardly comes off of the pivot shaft 25C even if the external force F is exerted on the operation lever 25B.

Figure 14A:
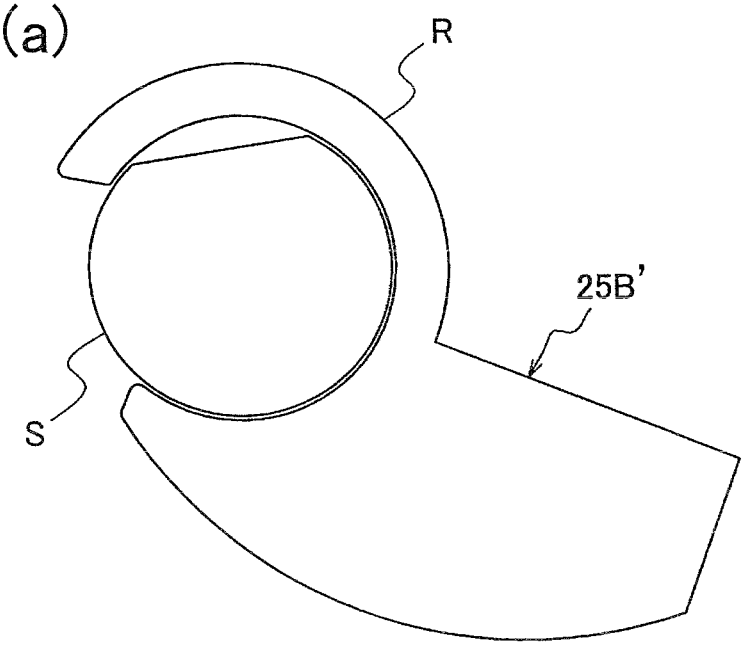
FIG. 14(*a*) is an illustrative view of a comparison structure.
Figure 14B:
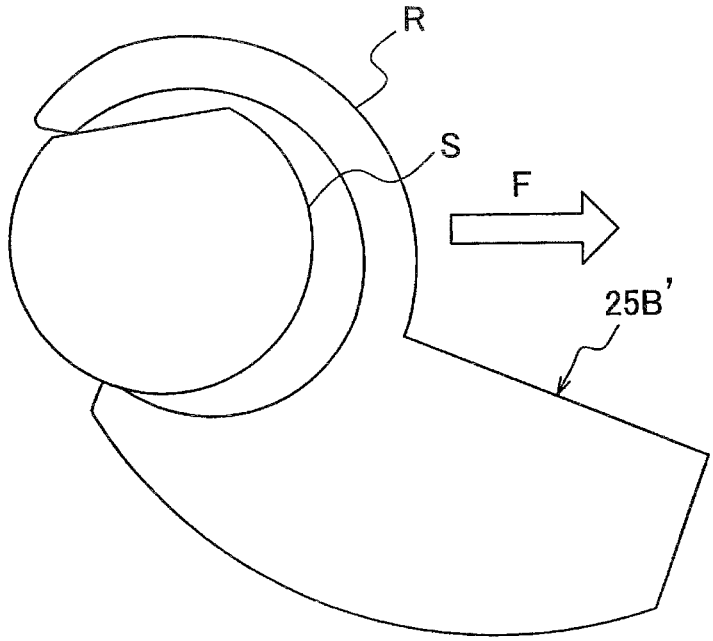
Figure 15:
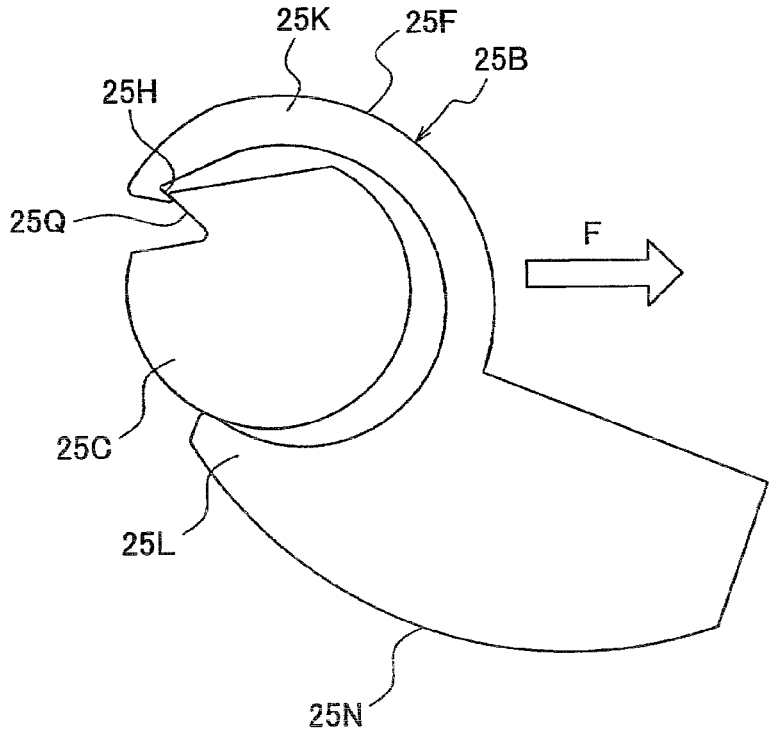
FIG. 15 is an illustrative view of an operation lever of the embodiment.

It is conceivable to employ a structure shown in FIG. 14(*a*) instead of the structure shown in FIG. 15 of the embodiment. In the structure shown in FIG. 14(*a*), an operation lever 25B' is rotatably supported to a pivot shaft S by fitting a substantial-C-shaped ring portion R over the pivot shaft S by deforming the ring portion R to stretch out.

However, although this structure can make easier to fit the operation lever 25B' over the pivot shaft S, there is a danger that the ring portion R deforms to stretch out when the external force F is exerted on the operation lever 25B', causing the operation lever 25B' to come off of the pivot shaft S.

This problem can be solved by increasing the rigidity of the ring portion R. However, increasing the rigidity of the ring portion R makes it difficult to fit the operation lever 25B' over the pivot shaft S.

On the other hand, according to the present embodiment, it is possible to prevent the operation lever 25B from coming off of the pivot shaft 25C event if the external force F is exerted on the operation lever 25B, without degrading workability. It is also possible to downsize a lever mechanism including the operation lever 25B and the like.

Because the lever-side barb surface 25H is only formed on the first arc portion 25K of the ring portion 25F (FIG. 11(*b*)), the shape of the ring portion 25F can be simpler than the case where the lever-side barb surfaces 25H are formed both on the first arc portion 25K and on the second arc portion 25L.

Because the pivot shaft 25C that rotatably supports the operation lever 25B is integrally formed with the pair of support members 25D as described above, it is possible to reduce a dimension W (FIG. 9) between outer surfaces of the support members 25D between which the pivot shaft 25C is located.

However, because the pivot shaft 25C is formed integrally with the support members 25D, it is not possible to attach the operation lever 25B to the pivot shaft 25C by inserting the pivot shaft 25C into a through hole formed in the operation lever 25B if the through hole has no open section like the cut-out part 25E.

As shown in FIG. 12, the image forming device 1 further includes an operation unit 32, a display unit 33, and a controller 30. The user can input various commands and the like through manipulation of the operation unit 32. The display unit 33 is for displaying various information. The controller 30 is for controlling the image forming section 5, the electric motor 31, and the display unit 33. The controller 30 receives a detection signal from the optical sensor 20B and an operation signal from the operation unit 32. The controller 30 is a microcomputer including a CPU, a RAM, and a non-volatile memory, such as a ROM, and controls the image forming section 5 based on an input signal from the optical sensor 20B or the operation unit 32 and on programs prestored in the non-volatile memory of the controller 30.

The controller 30 judges that the jam cover 18 is opened when the optical sensor 20B is kept in the ON state for a predetermined time duration. When the controller 30 judges that the jam cover 18 is opened while an image forming operation is being performed, then the controller 30 controls the image forming section 5 and the electric motor 31 to halt the image forming operation and also controls the display unit 33 to display a message for informing the user of the status.

Figure 13:
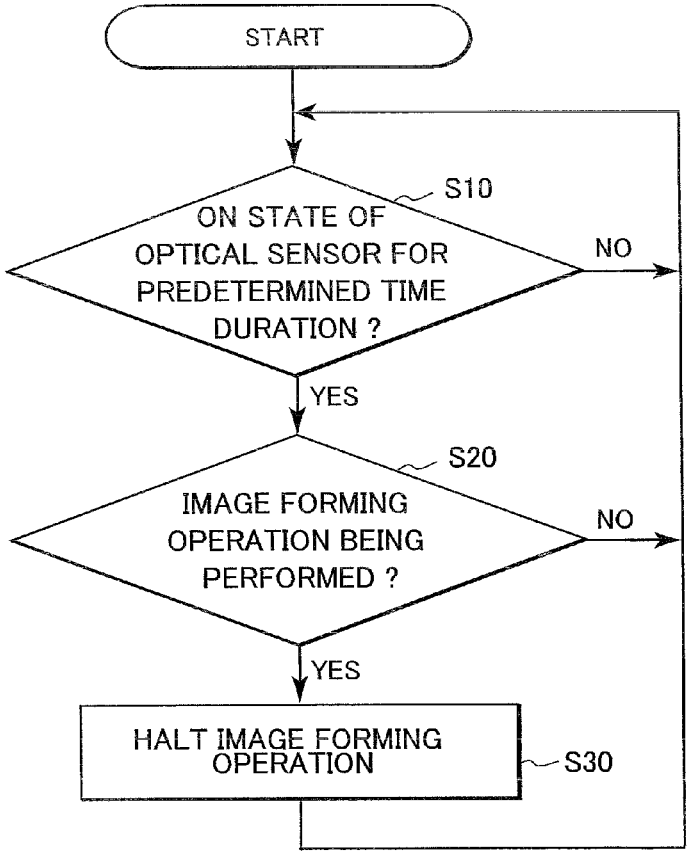
FIG. 13 is a flowchart representing a process executed in the image forming device.

More specifically, when power to the image forming device 1 is turned ON, the CPU of the controller 30 executes a process shown in FIG. 13 based on a program stored in the non-volatile memory. The process is terminated when the power to the image forming device 1 is turned OFF.

When the process starts, first in S10, it is determined whether or not the optical sensor 20B is in the ON state for the predetermined time duration. If so (S10:Yes), then it is determined in S20 whether or not an image forming operation is being performed in the image forming device 1.

The determination in S20 is made based on whether or not a print command is received from a computer or the like connected to the image forming device 1. If a positive determination is made in S20 (S20:Yes), then the process advances to S30. In S30, the controller 30 controls the image forming section 5 and the electric motor 31 to halt the image forming operation and controls the display unit 33 to display the message notifying the user of halt of the image forming operation. Then, the process returns to S10. On the other hand, if a negative determination is made in S10 or S20 (S10:No or S20:No), then the process returns to S10.

Because the image forming operation is halted when the jam cover 18 is detected open, even if the user applies excessive opening force on the rear cover 16 during the image forming operation and opens the jam cover 18 by mistake, it is possible to prevent such problems as paper jam.

While the invention has been described in detail with reference to the embodiment thereof, it would be apparent to those skilled in the art that various changes and modifications may be made therein without departing from the spirit of the invention.

Figure 16:
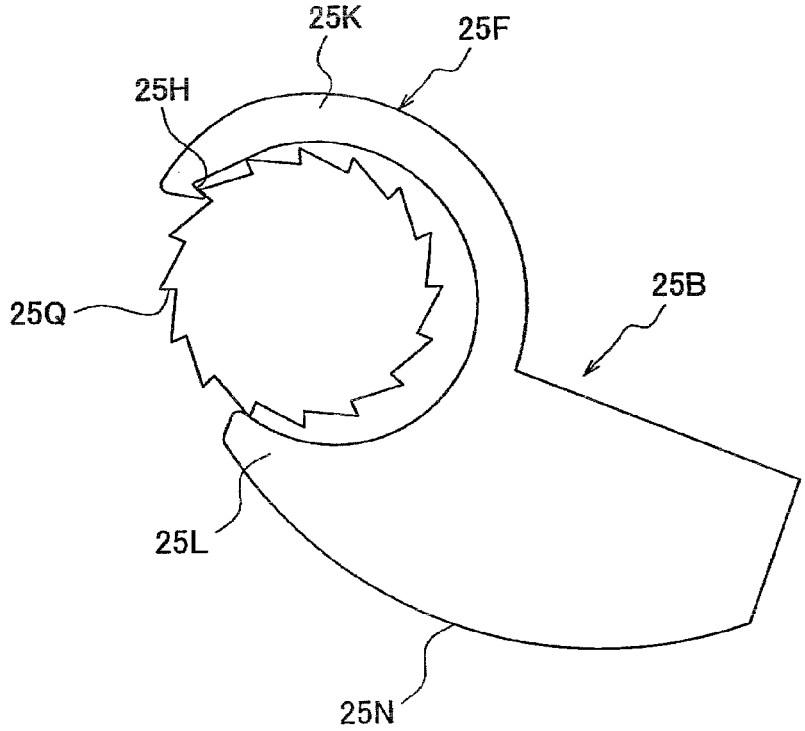
FIG. 16 is an illustrative view showing a pivot shaft according to a modification of the embodiment.

For example, as shown in FIG. 16, a plurality of shaft-side barb surfaces 25Q may be formed all around the outer periphery of the pivot shaft 25C.

Although the linking member 22A of the above-described embodiment is formed in the plate-like shape and functions also as the conveying chute 16A, this is not limitation of the invention.

The above-described embodiment pertains to the structures of the rear cover 16 and the jam cover 18. However, the invention may be applied to structures of different components.

In the above-described embodiment, the junction between the linking member 22A and the rear cover 16 is formed rotatable and movable in the direction substantial parallel to the direction D2. However, the junction between the linking member 22A and the jam cover 18 may be formed rotatable and movable in a direction substantial parallel to the direction D2. Alternatively, the linking member 22A may be fixed to the rear cover 16 at one end and have a shaft at the other end inserted into a through hole formed in the jam cover 18 so that the linking member 22A can move about the shaft.

In the above-described embodiment, the engaging member 21B and the engaged member 21C are formed on and near the top end 21E. However, this is not limitation of the invention.

The lock mechanism 21 may have a structure different from that described above. For example, the spring 21J may be a torsion spring. Also, the closed state of the rear cover 16 may be maintained by magnetic force instead of resilient force of the spring 21J.

The above-described embodiment pertains to the electrophotographic monochromatic image forming device 1. However, the present invention may be applied to a direct tandem-type laser printer, a color laser printer employing an intermediate transfer method, or the like.

What is claimed is:

1. An image forming device comprising:

a casing;

an image forming unit disposed in the casing and configured to form an image on a recording medium;

a pivot member disposed in the casing and configured to pivot about a first axis between a first position and a second position, the first axis being located at a lower portion of the pivot member;

a cover disposed outward of the pivot member and configured to pivot about a second axis from a closed position, the second axis being different from the first axis and located at a lower side portion of the cover;

a link mechanism configured to cause the cover and the pivot member to pivot together when the cover is positioned at a first angled position at which the cover pivots a first predetermined angle from the closed position;

a lock mechanism configured to maintain the pivot member at the first position; and a first roller and a second roller configured to convey the recording medium, the first roller being supported by the pivot member;

wherein:

as the cover pivots from the closed position to the first angled position, the pivot member is maintained at the first position;

as the cover pivots from the closed position beyond the first predetermined angle, the link mechanism causes the cover and the pivot member to pivot together, the lock mechanism to be released, the pivot member to pivot from the first position to the second position, and the first roller to move away from the second roller.

2. The image forming device according to claim 1, wherein the lower portion of the pivot member has one end portion and another end portion in an axial direction in which the first axis extends;

wherein the lock mechanism is disposed closer to the one end portion than to the another end portion.

3. The image forming device according to claim 1, wherein the link mechanism includes a link member pivotably supported to the pivot member at a first end portion and slidably supported to the cover at a second end portion opposite to the first end portion.

4. The image forming device according to claim 1, further comprising a stopper configured to prevent the cover from pivoting beyond a second predetermined angle that is greater than the first predetermined angle.

5. The image forming device according to claim 1, wherein:

the cover is formed in a substantial-plate shape;

the link mechanism includes a link member that is pivotably supported to the pivot member at a first end and to the cover at a second end opposite to the first end; and the link member is movable relative to the cover in a first direction substantially parallel to a second direction from the second axis toward a free end of the cover, the free end of the cover being remote from the second axis.

6. The image forming device according to claim 1, wherein:

the lock mechanism includes an arm provided to the pivot member, an engaging member formed at an end of the arm, an engaged member provided to the casing, and a resilient member that urges one of the engaging member and the engaged member toward the other one of the engaging member and the engaged member;

the end of the arm is remote from a pivot center of the pivot member; and engagement between the engaging member and the engaged member maintains the pivot member at the first position.

7. The image forming device according to claim 1, wherein the casing is formed with an opening; wherein the cover is configured to receive the recording medium discharged through the opening when the cover is position at the first angled position.

8. The image forming device according to claim 1, further comprising:

a detecting mechanism configured to detect pivot member being positioned at the second position; and a control unit configured to control the image forming unit to halt an image forming operation when the detecting mechanism detects pivot member at the second position.

9. The image forming device according to claim 1, wherein the cover includes a pressing member pressing the pivot member in a direction that the pivot member pivots from the second position to the first position when the cover is pivoted in a direction directed from the first angled position toward the closed position.

10. The image forming device according to claim 1, wherein the casing is formed with a discharge tray configured to receive the recording medium; the pivot member defines at least a part of a substantial-U-shaped path along which the recording medium is conveyed, the substantial-U-shaped path extending from the image forming unit to the discharge tray; and the substantial-U-shaped path is exposed when the pivot member is positioned at the second position.

11. The image forming device according to claim 1, wherein the link mechanism comprises a link member that is pivotably coupled to the pivot member at a first end and to the cover at a second end opposite to the first end.

12. The image forming device according to claim 11, wherein the link member is movable relative to the cover in a first direction substantially parallel to a second direction, the second direction being defined from the second axis of the cover toward a free end of the cover, the free end being remote from the second axis.

13. The image forming device according to claim 1, wherein the lock mechanism is provided in the casing.

14. The image forming device according to claim 13, wherein the lock mechanism includes:

a lever having a base end portion and a free end portion, the free end portion being pivotable about the base end portion; and an urging member configured to urge the free end portion of the lever toward the pivot member to maintain the pivot member at the first position.

15. The image forming device according to claim 14, wherein the lever is attached to the casing and pivotable in a direction perpendicular to a direction in which the first axis extends.

16. An image forming device comprising:

a casing;

an image forming unit disposed in the casing and configured to form an image on a recording medium;

a pivot member disposed in the casing and configured to pivot about a first axis between a first position and a second position, the first axis being located at a lower portion of the pivot member;

a cover disposed outward of the pivot member and configured to pivot about a second axis, the second axis being different from the first axis and located at a lower portion of the cover, the cover being pivotable between a closed position and a first angled position at which the cover pivots a first predetermined angle from the closed position, the cover being further pivotable between the first angled position and a second angled position at which the cover pivots a second predetermined angle from the closed position, the second predetermined angle being greater than the first predetermined angle;

a link mechanism configured to cause the cover and the pivot member to pivot together as the cover pivots from the first angled position to the second angled position, the pivot member pivoting from the first position to the second position as the cover pivots from the first angled position to the second angled position, the pivot member being maintained at the first position as the cover pivots from the closed position to the first angled position;

a lock mechanism configured to maintain the pivot member at the first position as the cover pivots from the closed position to the first angled position, the lock mechanism being released as the cover pivots from the first angled position to the second angled position; and a first roller and a second roller configured to convey the recording medium, the first roller being supported by the pivot member, the first roller moving away from the second roller as the cover pivots from the first angled position to the second angled position.

* * * * *